US007050966B2

(12) United States Patent
Schneider et al.

(10) Patent No.: US 7,050,966 B2
(45) Date of Patent: May 23, 2006

(54) SOUND INTELLIGIBILITY ENHANCEMENT USING A PSYCHOACOUSTIC MODEL AND AN OVERSAMPLED FILTERBANK

(75) Inventors: Todd Schneider, Waterloo (CA); David Coode, Waterloo (CA); Robert L. Brennan, Kitchener (CA); Peter Olijnyk, Waterloo (CA)

(73) Assignee: AMI Semiconductor, Inc., Pocatello, ID (US)

( * ) Notice: Subject to any disclaimer, the term of this patent is extended or adjusted under 35 U.S.C. 154(b) by 337 days.

(21) Appl. No.: 10/214,056

(22) Filed: Aug. 7, 2002

(65) Prior Publication Data

US 2003/0198357 A1 Oct. 23, 2003

(30) Foreign Application Priority Data

Aug. 7, 2001 (CA) ..... 2354755

(51) Int. Cl.
*G10L 11/06* (2006.01)

(52) U.S. Cl. ..... 704/200.1; 704/269

(58) Field of Classification Search ..... 704/269, 704/270, 205, 275; 381/314
See application file for complete search history.

(56) References Cited

U.S. PATENT DOCUMENTS 5,388,185 A 2/1995 Terry et al.
6,236,731 B1 * 5/2001 Brennan et al. ..... 381/316
6,240,192 B1 * 5/2001 Brennan et al. ..... 381/314

FOREIGN PATENT DOCUMENTS

WO PCT/CA98/00331 10/1998
WO PCT/CA00/00434 11/2000

OTHER PUBLICATIONS

Young-Cheol, Park: High Performance Digital Hearing Aid Processor with Psychoacoustic Loudness Correction; ICCE, International Conference on Consumer Electronics; 1997; pp. 312-313; Samsung Electronic Co. Ltd, Yongin-City, Kyungki-Do, Korea.

Schneider, Todd et al.; A Multichannel Compression Strategy for a Digital Hearing Aid; 1997 IEEE International Conference on Acoustics, Speech, and Signal Processing; Apr. 21-24, 1997; pp. 411-414; Unitron Industries, Ltd., Kitchener, Ontario, Canada.

* cited by examiner

*Primary Examiner*—Susan McFadden

(57) ABSTRACT

A system and method of improving signal intelligibility over an interference signal is provided. The system includes a psychoacoustic professor having a psychoacoustic model wherein the level of a signal-of-interest is improved so as to be audible above noise and so as not to exceed a predetermined maximum output level. The system can be combined with active noise cancellation.

29 Claims, 13 Drawing Sheets

F' approximates or is equivalent to transfer function F

SOUND INTELLIGIBILITY ENHANCEMENT USING A PSYCHOACOUSTIC MODEL AND AN OVERSAMPLED FILTERBANK

FIELD OF THE INVENTION

The present invention relates to audio reproduction applications where a desired audio signal is received in an uncontaminated form and interference (e.g. environmental noise) is present as an acoustic signal.

BACKGROUND OF THE INVENTION

In acoustically noisy environments, listeners often have difficulty hearing a desired audio signal or "signal-of-interest". For example, a cellular phone user in an automobile may have difficulty understanding the received speech signal through their headset because the noise of the automobile masks the signal-of-interest (i.e., the speech signal received by the cell phone). Many attempts have been made in the past to solve this problem. Some of them are described briefly as follows:

(a) Passive noise attenuating headsets: For the specific application in headset applications, passive noise attenuation is provided by a large and bulky ear cup that physically isolates the environmental (acoustic) noise from the users ear.

(b) Amplification: The incoming electrical signal-of-interest is amplified to overcome the background noise level. If not properly controlled, this can result in dangerously loud output levels. Also, unless the amplification well-controlled it may not provide the desired benefit.

(c) Filtering: The signal is statically filtered to make it more intelligible (d) Simple Automatic Gain Control (AGC): The signal-of-interest is passed through an automatic gain control (AGC) system in which gain is adjusted based on a level measurement of the noise inside or outside the ear cup. The gain of the AGC is typically controlled by a simple measurement of the overall noise level.

(e) Active noise cancellation (ANC): Anti-noise (generated using either an open- or closed-loop servo system) is generated and added acoustically to the noise signal. For headset applications, sec Bose, Amar, et. al. Headphoning, U.S. Pat. No. 4,455,675. Jun. 19, 1984. and Moy. Chu. Active Noise Reduction in Headphone Systems, Headwize Technical Paper Library, 1999.

(f) Sometimes, these methods are combined: a common scheme for a headset application is to combine a passive noise-attenuating headset with an ANC system (see Bose, Amar, et. al. Headphoning, U.S. Pat. No. 4,455,675. Jun. 19, 1984).

Although these methods are highly effective and reduce the noise for a wide range of applications, they are not always suitable. For example, ANC-requires an accurate noise reference, which may not be available and works only at lower frequencies. Passive noise reduction works well only if sufficient room is available for the sound insulation. Filtering distorts the signal frequency content. AGC systems do not consider the human auditory system and yield sub-optimal results Also, even when these solutions can be applied, applications exist where the power drain of these solutions is prohibitive and a miniature, low power technique is required.

Accordingly, there is a need to solve the problems noted above and also a need for an innovative approach to enhance and/or replace the current technologies.

SUMMARY OF THE INVENTION

It is an object of the present invention to provide a novel method and system for improving a signal quality and a signal intelligibility.

In accordance with an aspect of the present invention, there is provided a system for improving a, signal intelligibility over an interference signal, which includes: an analysis filterbank for transforming an information signal in time domain into a plurality of channel information signals in transform domain, a signal, processor for processing the outputs of the analysis filterbank, the signal processor including a psychoacoustic processor for computing a dynamic range using a psycoacoustic model to render the information signal audible over the interference signal, and a synthesis filterbank for combining the outputs of the signal processor to generate an output signal.

The Signal Intelligibility Enhancement (SIE) of the invention is designed to alleviate the disadvantages and shortcomings of the prior art implementations. It can be used in environments where there are very high levels of noise relative to the level of the signal-of-interest. Such environments can result in a very restricted available dynamic range. While it is possible to use simple dynamic range compression methods of earlier systems to map the signal-of-interest into this small dynamic range, the resulting signal fidelity and quality may suffer. In this situation, applying the minimum gain required to make the signal-of-interest audible over the desired noise (and therefore more intelligible) results in improved signal quality. The present invention is therefore directed at determining and applying this minimum gain According to the present invention, the SIE processing incorporates a psychoacoustic model that calculates, on an on-going basis, the minimum amplification that must be applied to make the signal-of-interest audible over the undesired signal. This results in better fidelity and signal quality.

According to the present invention. Signal Intelligibility Enhancement (STE) algorithm utilizes a measurement of either (1) the level of the outside interference (undesired signal, noise) or (2) the level of the interference (undesired signal, noise) in the headset ear cup or in the ear canal to adaptively adjust the gain and equalization of the signal-of-interest (electrical) so that the intelligibility and audibility of the signal-of-interest is improved. These level measurements are made using frequency band levels alone on in combination using techniques that are well-known in the art and are described in Schneider, Todd A. An Adaptive Dynamic Range Controller, MASc Thesis. University of Waterloo, Waterloo, Ontario, Canada 1991, Schneider & Brennan, A Compression Strategy for a Digital Hearing Aid, Proc ICASSP 1997, Munich, Germany, and Schmidt, John, Apparatus for Dynamic Range Compression of an Audio Signal, U.S. Pat. No. 5,832,444.

In summary, by using the invention, the user can receive a signal with improved SNR (signal-to-noise ratio) that continuously adapts to the user's environment, rendering the signal-of-interest at a comfortable level. This results in improved signal intelligibility, improved perceived signal quality and less user fatigue.

To provide the best possible fidelity, ultra miniaturized size and the lowest possible power consumption, the SIE algorithm is preferably implemented using an oversampled filterbank to separate both the, signal-of-interest and the undesired signal into a number of overlapping, abutting or non-overlapping bands. A suitable oversampled filterbank is described in U.S. Pat. No. 6,236,731 Schneider & Brennan, Filterbank structure and method for filtering and separating an information signal into different bands, particularly for audio signal in hearing aids. The design is advantageously implemented in an architecture that combines a weighted overlap add (WOLA) filterbank, a software programmable DSP core, an input-output processor and non-volatile memory Such an architecture is described in U.S. Pat. No. 6,240,192, Schneider & Brennan, Apparatus for and method of filtering in a digital hearing aid, including an application specific integrated circuit and a programmable digital signal processor.

This invention can be used in any application where it is necessary to improve the intelligibility of a received audio signal containing significant noise white maintaining high fidelity and good signal quality. Typical applications of the invention include headsets used in call centres, mobile phones, and other miniature/portable audio devices when used in noisy environments (e.g., aircraft concerts, factories. etc.).

A further understanding of the other features, aspects, and advantages of the present invention will be realized by reference to the following description, appended claims, and accompanying drawings.

BRIEF DESCRIPTION OF THE DRAWINGS

Embodiments of the invention will now be described with reference to the accompanying drawings, in which.

DETAILED DESCRIPTION OF THE PREFERRED EMBODIMENTS

The preferred embodiments will be described with particular reference to the use of a headset by a listener, to which the present invention is principally applied, but not exclusively.

Figure 1:
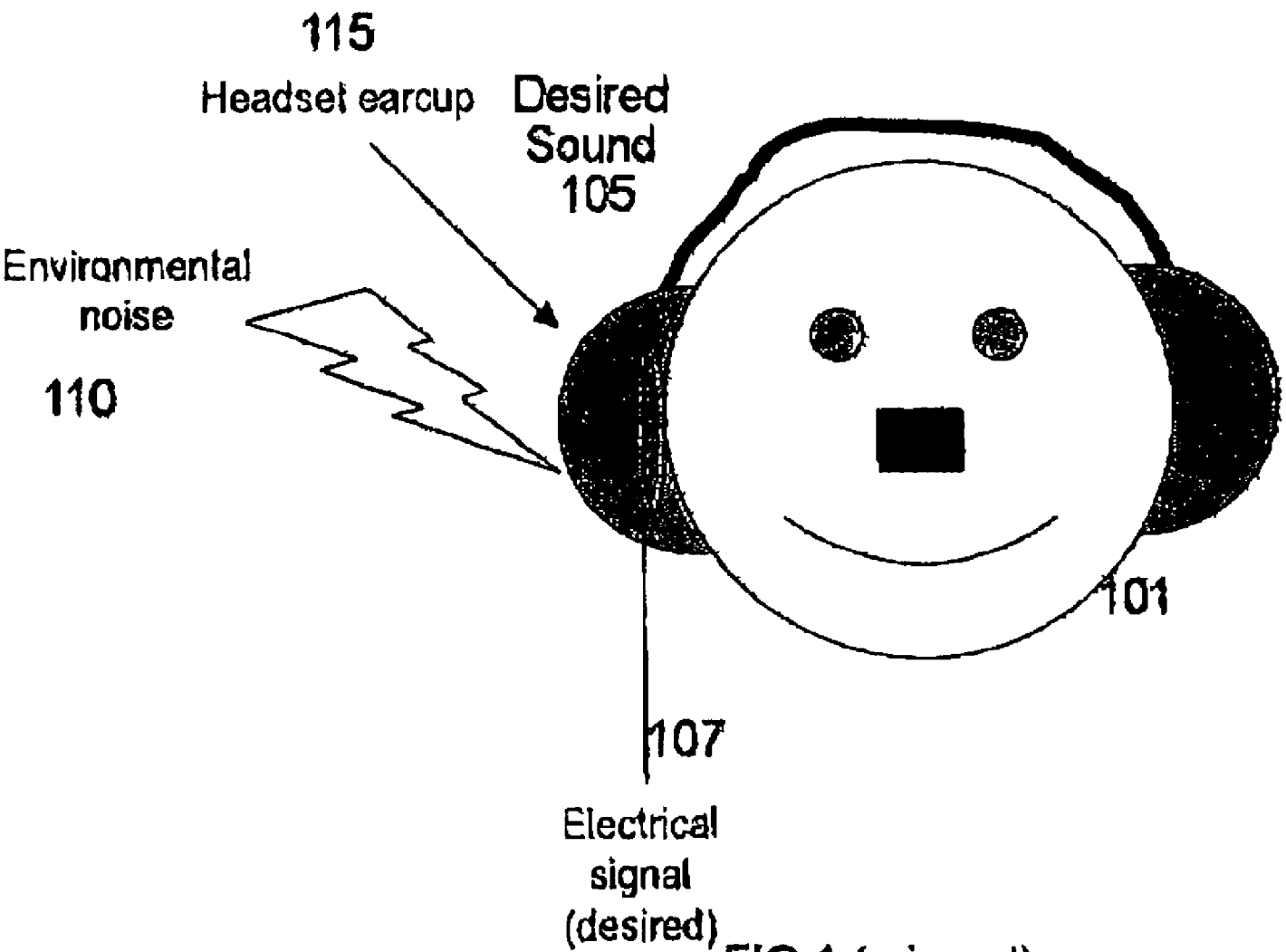
FIG.1 (prior art)
FIG. 1 illustrates a typical situation for a receive algorithm.

Signal processing algorithms for audio listening applications are commonly called "receive algorithms" (Rx) because the listener wants to hear the received audio signal. A typical application for the Signal Intelligibility Enhancement (SIE) processing of the invention is a headset being used in a noisy environment FIG. 1 shows diagrammatically the components and signals of interest. The listener 101 hears a combination of the desired sound 105, derived typically from an electrical signal 107, and the environmental (or ambient) noise 110 that is an undesired signal that may reduce the intelligibility of the signal-of-interest. The passive attenuation provided by the headset 115 reduces the audible level of the environmental noise.

Figure 2:
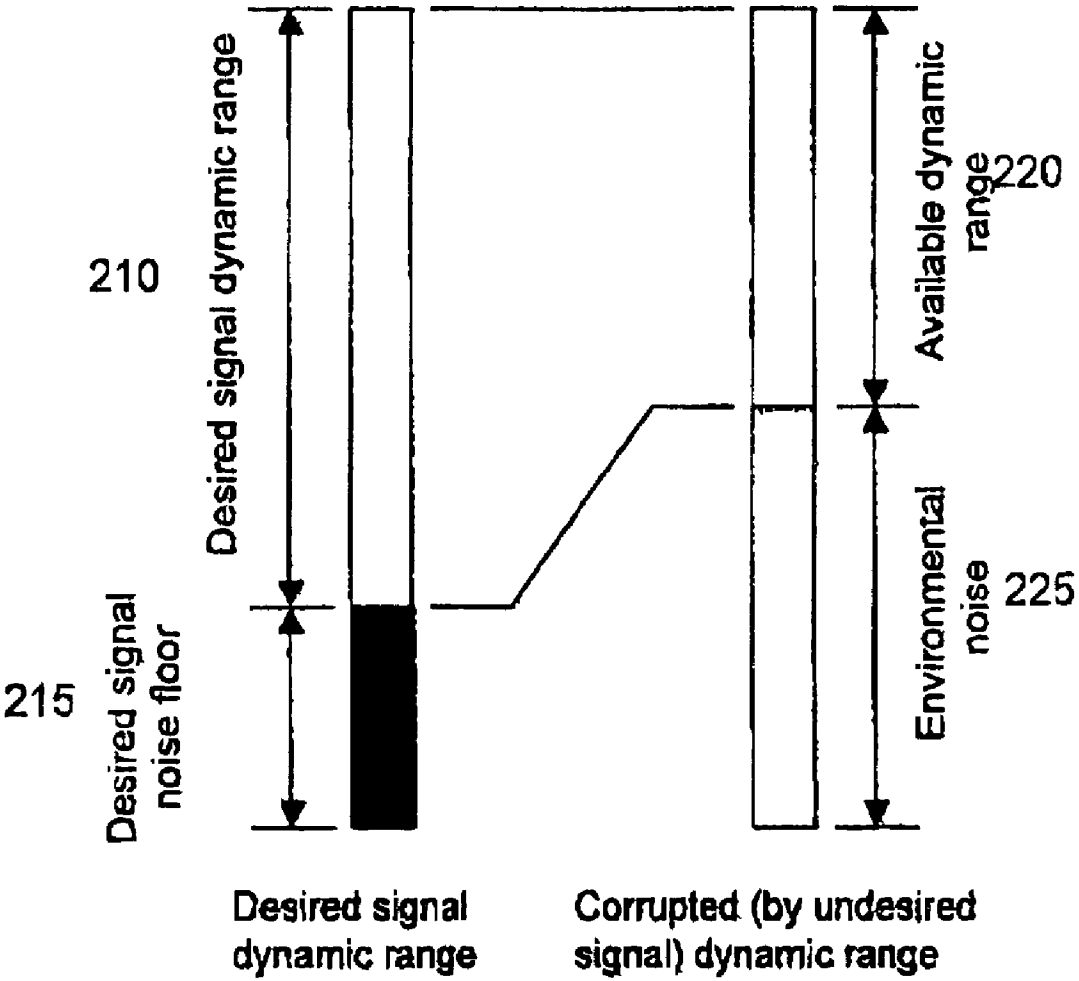
FIG. 2 (prior art)
FIG. 2 is a schematic representation of a dynamic range mapping of signal-of-interest into available dynamic range.

If the level of signal-of-interest falls significantly below the level of the noise signal in the ear canal, the signal-of-interest is masked and can be inaudible. The listener also has a maximum signal level that is considered comfortable (Loudness Discomfort Level—LDL). LDL may be a simple frequency-based measurement of a discomfort level (as is well know in the art for audiological hearing assessment and fitting) or it may be a complex measure of psychoacoustic loudness that accounts for signal level within critical bandwidth, frequency content, signal duration or other relevant psychoacoustic parameters. The difference in level between the level of the noise signal and the LDL, which are both functions of frequency, is the effective dynamic range, which also a function of frequency. Because of the level of the undesired sisal (i.e. noise), the listener experiences reduced dynamic range. Remapping the dynamic range of the signal-of-interest in a frequency dependent manner raises its level above the ambient noise making the signal-of-interest audible. However, the amplification must not allow the level of the signal to exceed the maximum signal level that is comfortable for the listener (LDL). The solution is to map the dynamic range of the original signal-of-interest into the available dynamic range of the signal in the presence of environmental noise. This type of signal processing is called dynamic range compression. This mapping is shown for a single frequency band in FIG. 2, in which the desired (or original) dynamic range 210, with its noise floor 215, is compared with the corrupted dynamic range 220, with its noise floor 225 raised by the environmental noise. The goal of dynamic range compression is therefore to purposely distort the dynamic range of the signal-of-interest while minimizing the perceived distortion.

Figure 3:
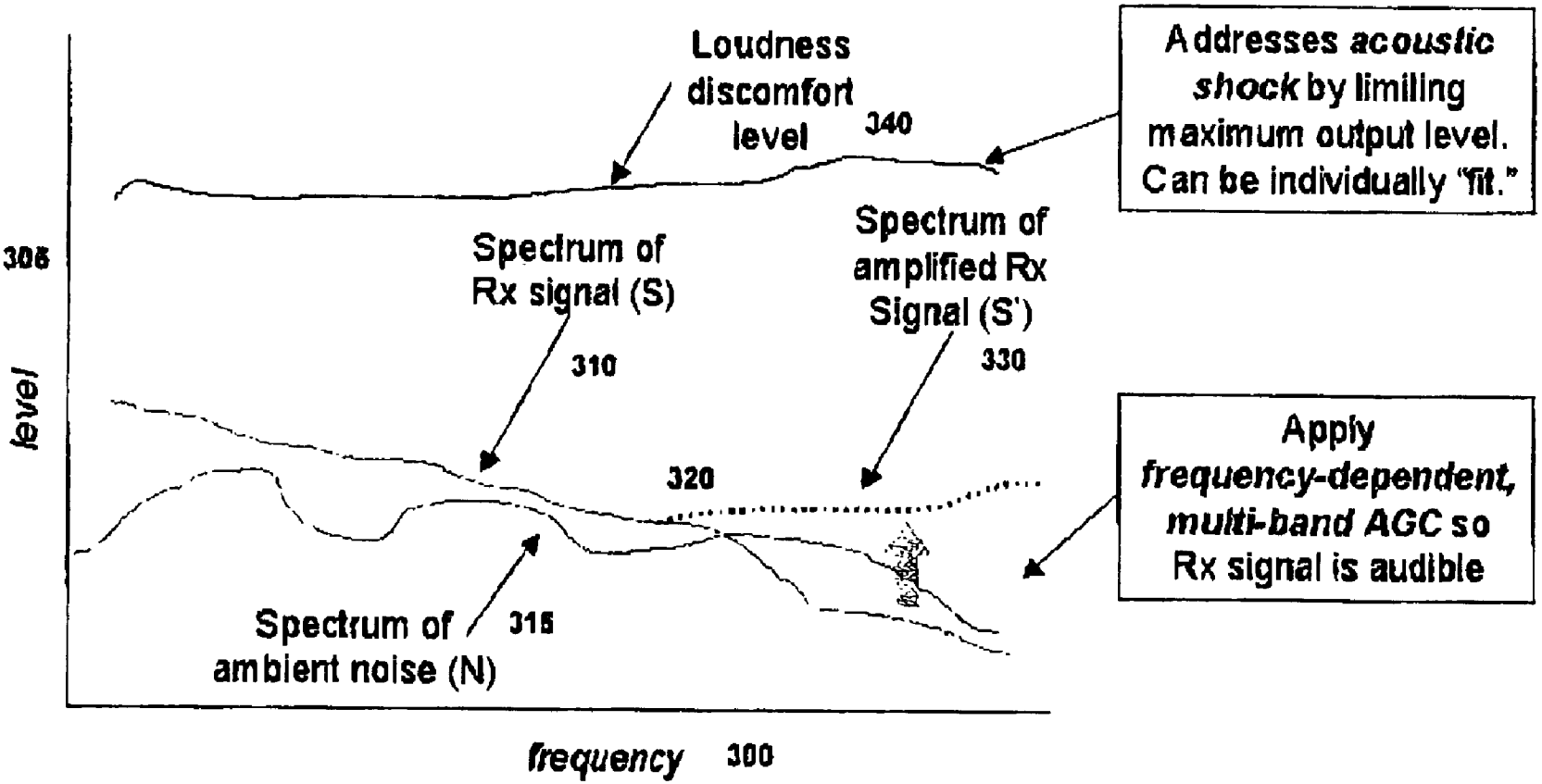
FIG. 3 (prior art)
FIG. 3 shows a basic operation of the signal intelligibility enhancement according to the present invention.

A version of this dynamic range compression operation acting as a function of frequency is now described with reference to FIG. 3. The figure shows the spectra of the desired signal-of-interest 310 and the undesired (environmental) noise 315 in a graph having scales of frequency 300 versus arbitrary level 305. Note that above a certain frequency 320 the level of the signal of interest 310 falls close to and below the undesired noise 315. In the system, the signal-of-interest 310 is selectively, that is, depending on frequency and input level, amplified 330 as a function of the input level so that it is audible above the noise floor. This operation is advantageously implemented in a plurality of overlapping or non-overlapping frequency bands where the bands can be processed independently or grouped into channels and processed together. For completeness, the FIG. 3 also shows the aforementioned Loudness Discomfort Level (LDL) 340.

In the following descriptions of preferred embodiments all of the paths between the one or more analysis filterbanks and the synthesis filterbank should be considered to have N dimensions (parallel paths), since there are N sub-bands derived by the analysis filterbanks, and each requires a separate path. This consideration also applies to any function blocks interposed between the filterbanks, since each sub-band is to be considered and operated on separately The present invention is particularly applicable where the N>1;

although typically N>=16. In some embodiments, these N sub-bands are grouped into K channels, where each channel comprises one or more adjacent sub-bands, and each channel is then processed so that all of the sub-bands within that channel get the same gain.

Figure 4:
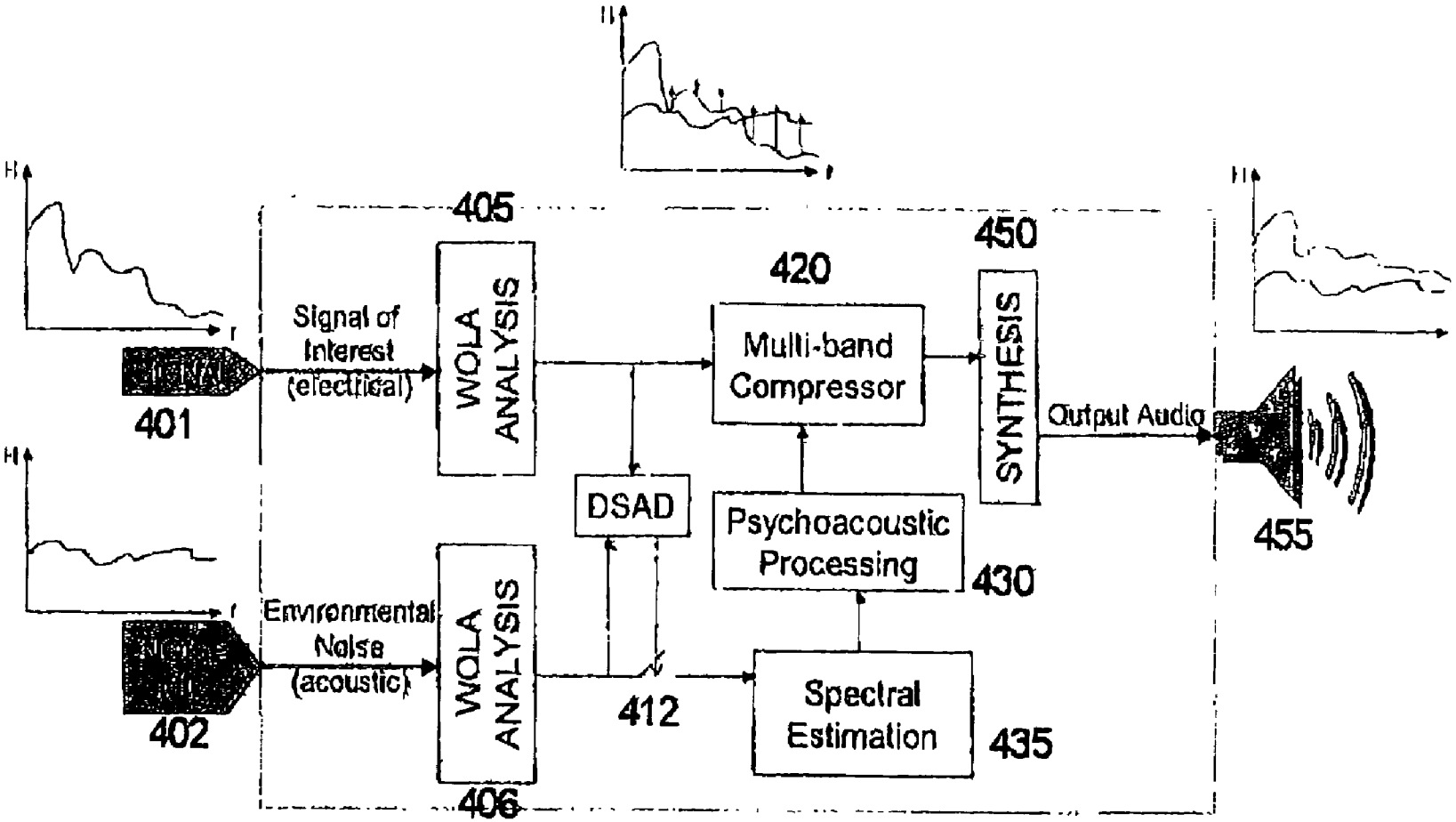
FIG. 4 shows a high-level block diagram of STE processing according to the invention, incorporating a Desired Signal Activity Detector (DSAD) (or Voice Activity Detector (VAD))

Referring to FIG. 4 that shows a block diagram of an embodiment of the invention, a first acoustic input device (Signal Microphone) 401 receives the signal of interest (typically speech), and passes it to a first WOLA analysis filterbank 405. A second acoustic input device (Noise Microphone) 402 receives the environmental noise, possibly contaminated with the signal-of-interest and passes it to a second WOLA analysis filterbank 406. The second acoustic input device 402 is typically located either inside the ear canal (a so-called closed-loop implementation) or outside the ear canal (a so-called open-loop implementation). Each filterbank breaks the input signal into N sub-bands.

Any differences between these implementations are pointed out in the following description. In a closed loop implementation, equalization is included to account for the acoustics of the signal path (e.g., an acoustic tube that supplies audio to a microphone molded into the ear cup). By contrast, in an open loop implementation, a model of the transfer function from the microphone to the inside of the ear canal is incorporated to account for the attenuation and frequency response of the headset ear cup and acoustic signal path. A model of the output stage can also be included so that the level of the signal-of-interest that may appear in the ear canal, prior to any adaptive equalization, can be approximated In an open-loop implementation, a separate or shared environmental noise microphone can be used. In the shared microphone case, the same microphone can be used for transmitting a signal (e.g., transmitted speech in a headset application). This reduces costs and simplifies mechanical construction. In this case, a signal or voice activity detector is required to ensure that the noise spectral estimate does not contain any of the transmitted signal.

In operation, the psychoacoustic model incorporated in the psychoacoustic processing block 430 receives the level of the signal-of-interest in frequency sub-bands or combinations of frequency sub-bands (channels) covering the desired signal spectrum as produced by the first (signal-of-interest) WOLA analysis filterbank 405. The psychoacoustic processing block 430, using the level of environmental noise in those same frequency bands or combinations frequency bands (channels) but applied to the environmental noise spectrum as produced by the second (environmental noise) WOLA analysis filterbank 406, then computes dynamic range parameters. These computed parameters are passed to the multi-band compressor 420 that, in turn, applies them to the sub-bands derived by the first (signal-of-interest) WOLA analysis filterbank 405. The multi-band compressor 420 then uses the dynamic range parameters supplied by the psychoacoustic processing block 430 to equalize the signal as a function of frequency thereby improving its audibility or intelligibility. The use of a psychoacoustic model, combined with well-known dynamic range compression techniques, ensures that the output audio is made audible and intelligible over the environmental noise while minimizing perceived distortion and maintaining the quality of the desired signal. The Desired Signal Activity Detector (DSAD) block 410, receives outputs from both WOLA analysis filterbanks 405, 406 and controls the updates to the estimate of the noise spectrum by the spectral estimation block 435 This spectral estimation block 435, described next, provides further information to the psychoacoustic processing block 430. The outputs of the Multi-band compressor 420 are supplied to a synthesis filterbank 450. The synthesis filterbank 450 transforms the outputs the Multi-band compressor 420 to output a time-domain audio signal.

Noise Estimation

An important input to the SIE signal processing carried out in the psychoacoustic processing block 430 is the spectrum of the environmental noise supplied by the second input device 402. The Spectral Estimation block 435 of SIE processing of the invention includes an adaptive estimation technique or a spectral differencing technique. These, together with a desired signal activity detector (DSAD) 410, permit an accurate, uncontaminated estimate of the environmental noise spectrum to be determined. In a further preferred embodiment, the environmental noise is obtained by using a shared-input microphone (see below).

In the open-loop case, noise estimation is done using shared or separate microphones. A DSAD or VAD on the shared or separate microphone controls updates to the spectral estimate of the noise that is derived via spectral analysis from the shared or separate microphone. If speech (or some other signal of interest) is detected on the shared or separate microphone, the spectral estimate of the noise is not updated (Note that spectral differencing and adaptive estimate are not used in the open-loop case.)

In the closed-loop case, a mixed version of the signal plus noise is received by a microphone located inside the ear cup. In this case, we need to remove the signal (which is known since we have an electrical version of it). This is done using spectral differencing or adaptive estimation techniques.

Desired Signal Activity Detector (DSAD)

The DSAD 410 employs techniques well-known in the art to sample the spectrum of the signal when the desired signal is not present (i.e. during pauses or breaks in the desired signal). This ensures that the algorithm does not consider the desired signal (or in the case of a headset application with a shared microphone, the transmitted speech) to be part of the environmental noise.

In embodiments using a closed-loop implementation, when the DSAD 410 indicates that there is no desired signal-of-interest present, the noise spectral image is updated, thereby minimizing contamination of the resultant spectrum by the signal-of-interest. In other embodiments using an open-loop implementation, the DSAD 410 may optionally monitor the environmental noise signal to ensure that transmitted speech or other signals-of-interest do not contaminate the noise spectrum that is supplied as an input to the psychoacoustic model.

In a closed-loop implementation, if the noise spectrum has not been updated for some predetermined time period, the output audio may optionally mute for a brief period of time so that the noise spectrum can be updated without the desired signal being present. Using the DSAD in combination with timed updates (when necessary) ensures that noise spectrum is always current and that it is never contaminated with the desired signal spectrum.

Adaptive Noise Estimation

In a preferred embodiment of the invention, adaptive noise estimation is used that employs techniques that are well-known in the art to estimate the environmental noise, but in the context of an oversampled WOLA sub-band filterbank a technology described in the co-pending patent application, which is filed on the same day by the present applicant entitled "Subband Adaptive Processing in an Oversampled Filterbank" Canadian Patent Application, serial 2,354,808, U.S. application Ser. No. 10/214,057, the disclosure of which is incorporated herein by reference, may also be used.

Figure 5:
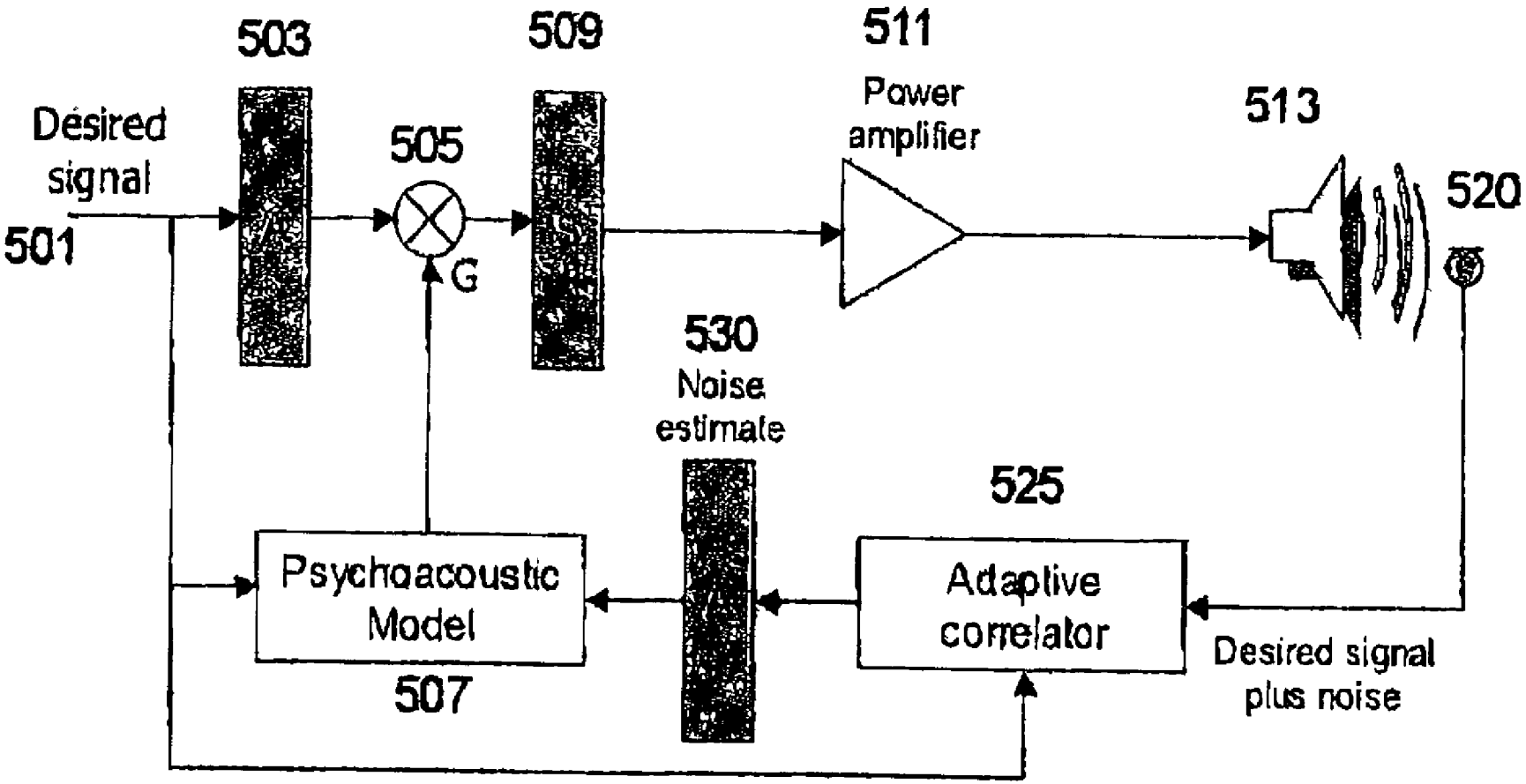
FIG. 5 shows a block diagram of SIE using adaptive noise estimation.

FIG. 5 shows a block diagram of SIE with Adaptive Noise Estimation. Although a time domain technique is described, it would be understood by one skilled in the art that transform (cg frequency) domain techniques are also possible and may be advantageous. The desired signal 501, already in electronic form is passed to a first analysis filterbank 503, which produces a number of sub-bands as in the previous embodiments. Each sub-band is then multiplied by the multiplier 505 with a function G derived from a Psychoacoustic Model block 507. The results of the gain application are passed in turn to a synthesis filterbank 509 which transforms the modified signal from the sub-bands and passes the output to power amplifier 511 which drives a receiver 513. A microphone 520, located physically close to receiver 513 delivers its output being the desired signal contaminated with various noise components including environmental noise, to an adaptive correlator 525. The output of the adaptive correlator 525, which is an estimate of the noise signal, is broken into sub-bands by a second analysis filterbank 530. The sub-bands from the second analysis filterbank 530 are also-passed to the Psychoacoustic model block 507. As described above the adaptive estimate can also be done in the transform domain.

Adaptive noise estimation requires no breaks in the desired signal-of-interest to estimate the noise. The noise is continuously estimated using the correlation between the contaminated signal derived from the microphone 520 and the desired electrical input signal 501 (the signal-of-interest). The output of the adaptive correlator 525 contains primarily the signal components that are uncorrelated between the desired signal 501 and the desired signal plus noise 520.

Noise Estimation by Spectral Differencing

Spectral differencing takes the difference between a filtered or unfiltered version of the transform domain representation of the signal-of-interest and the transform domain representation of the environmental noise signal. This subtraction can be done in bands or groups of bands. This estimation method is especially advantageous in closed-loop implementations (see below) where the environmental noise signal also contains the signal-of-interest because of the acoustic summation of the environmental noise and SIE processed signal-of-interest.

Filtering the signal-of-interest can be employed to derive a more accurate estimate. Where the filter has a frequency response equivalent or approximately equivalent to the frequency response of the output stage (SIE equalization, amplifiers loudspeaker and acoustics) and microphone, then the subtraction in the transform domain provides an excellent approximation to the uncontaminated (with the signal-of-interest) environmental noise. This filtering may optionally include calibration to null-out transducer or other differences and may be done using one of off-line or on-line line techniques.

Figure 6:
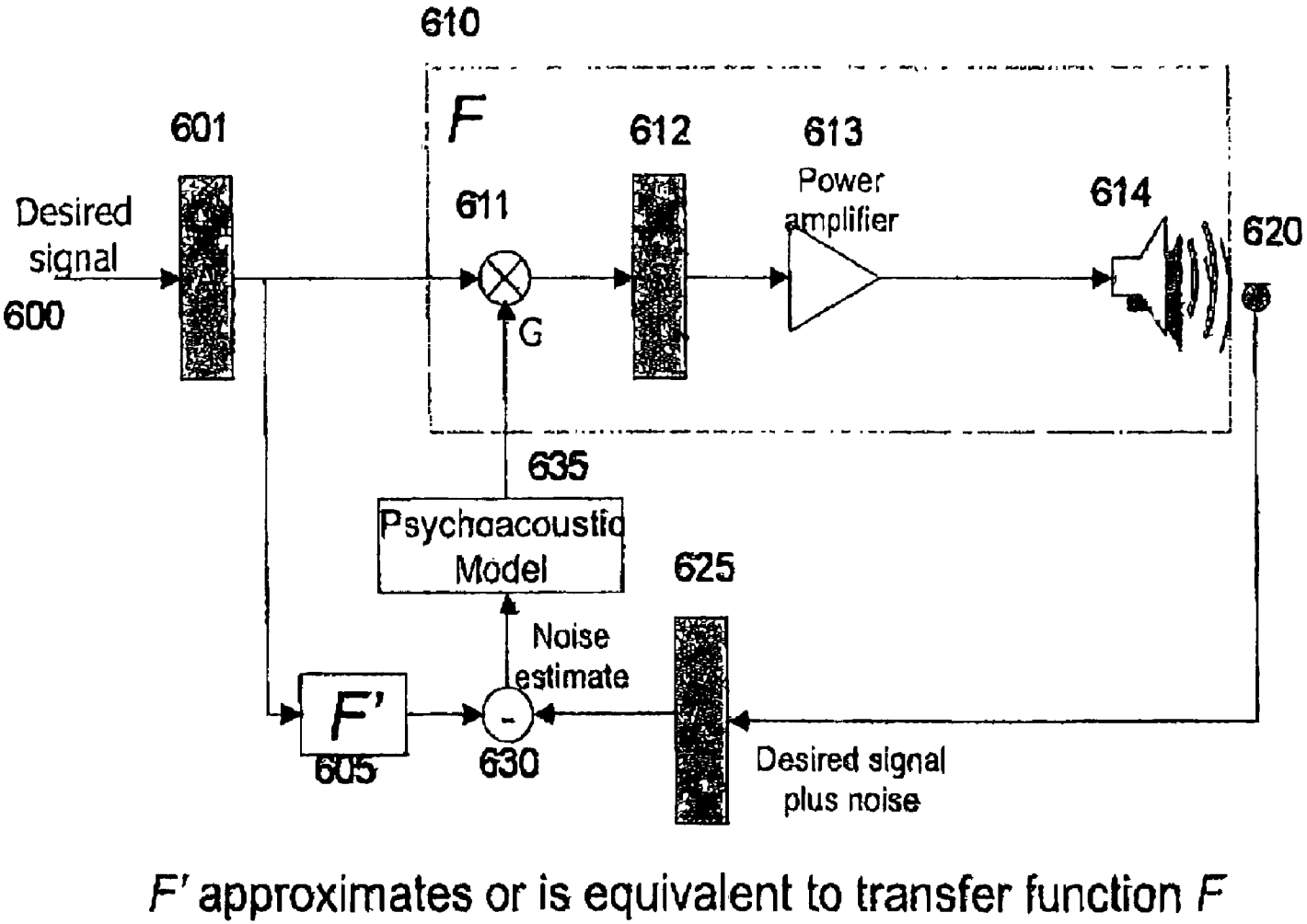
FIG. 6 shows a block diagram of SIE using spectral differencing noise estimation.

Like adaptive estimation, spectral differencing requires no breaks in the desired signal to estimate the noise—the noise is continuously estimated using the spectral difference between the two signals. FIG. 6 illustrates such a system in which a new function F 605 is introduced that approximates the overall transfer function F 610 of the signal path between the analysis filterbank 601 and the receiver 614. The signal path comprises a multiplier 611, a synthesizing filterbank 612, a power amplifier 613 and the receiver itself 614. A sampling microphone 620 feeds a signal representing the desired signal plus any introduced noise to a second filterbank 625, whose output is combined with the result of the function F 605 acting on the appropriate sub-band of the desired signal to produce a noise estimate 630 which is fed into the psychoacoustic model 635. The gains output from the psychoacoustic model 635 are then multiplied with each sub-band at a multiplier 611.

Figure 6A:
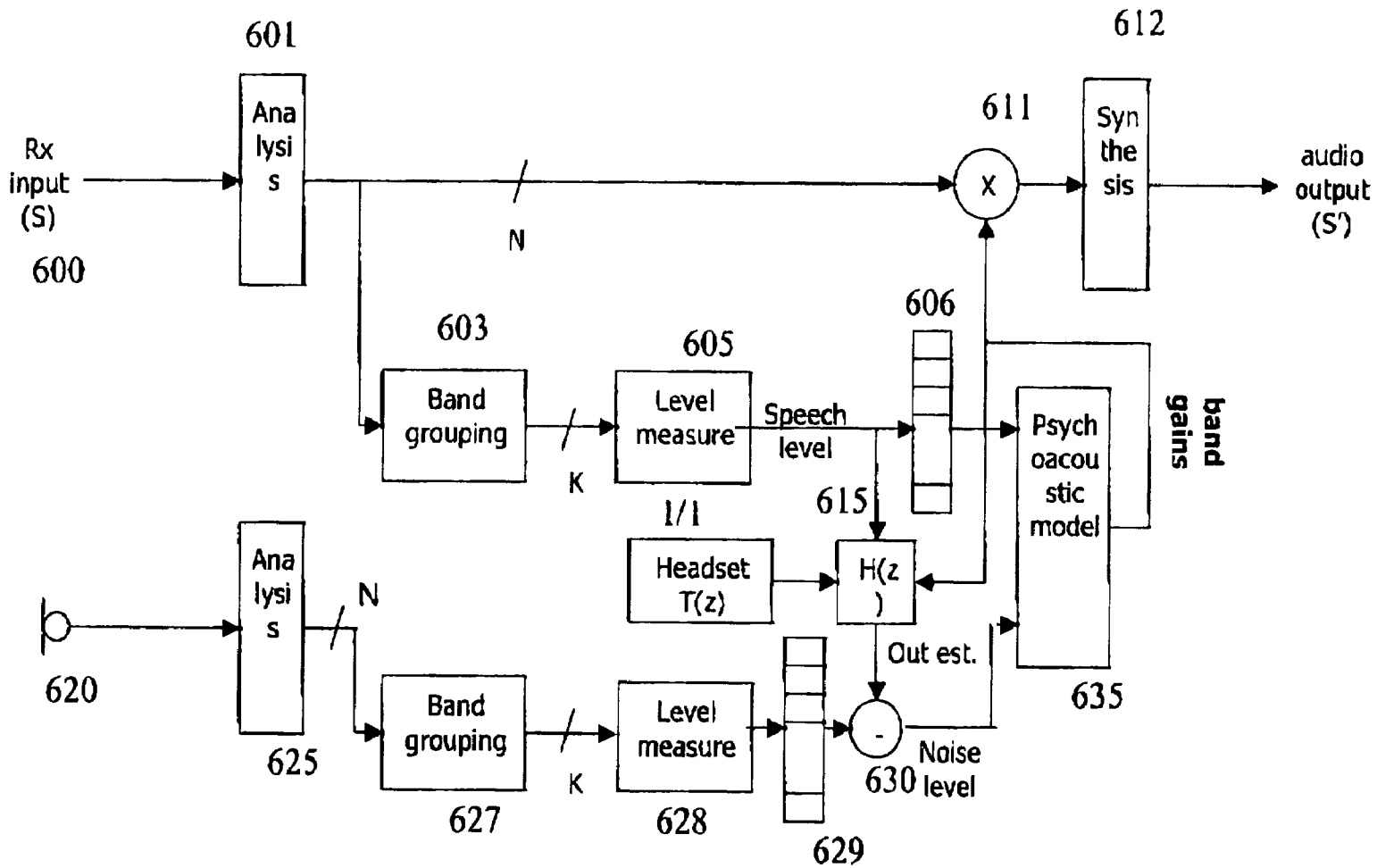

FIG. 6*a* shows a further embodiment in which N sub-bands are combined into K channels, and a further function, related to an estimation of the headset performance characteristics is introduced. Those components duplicating the functions in FIG. 6 are not described. The N output sub-bands of the analysis filterbanks 601, 625 are passed to band grouping blocks 603, 627 which combine several bands into a single channel, so that only K channels are further processed (where K<N) The outputs of the band grouping blocks pass to level measuring blocks 603, 627 respectively where the levels of each channel are measured the results passed in turn to the appropriate level registers 606, 629. The psychoacoustic model 635 uses the signal of interest and 'signal+noise' levels for the channels stored in the registers 606, 629 to compute the gains to be applied to each band. In addition, these gains are used in a feedback manner to adjust the function H(z) 615 which approximates the transfer function of the headset using a model 640. The output of the function H(z) adjusts the levels of noise as presented to the psychoacoustic model 635, using a subtractor 630.

Psychoacoustic Processing

Four different strategies for the psychoacoustic model 635, and combinations thereof can be employed to calculate the gains that are applied to the transformed signal domain. The gains are computed to ensure that the processed version of the desired signal is always audible over the environmental noise and that it is always comfortable for the listener. In all cases the LDL gives the upper limit of the dynamic range.

1) The lower limit of the dynamic range is set by the energy of the environmental noise within a frequency band or combination of bands.

2) The lower limit of the dynamic range is set by the level of the environmental noise within a frequency band or combination of bands, multiplied by a factor (X) between 0 and 1, which is adjustable. This factor controls the amount to which the apparatus amplifies low-level signals-of-interest. A lower X results in more dynamic range being available for the signal-of-interest and improves signal quality. Too low an X will mean that at low-levels, the signal-of-interest is masked by the environmental noise.

3) The lower limit of the dynamic range is determined by a complex psychoacoustic model which considers the level, spectral content and spectral nature of both the signal-of-interest and environmental noise to calculate the minimum audible and intelligible level within the noise, as is well known in the art.

4) The lower limit of the dynamic range is set by subtracting the SNR of the signal-of-interest from the energy of the noise within a channel.

In a preferred embodiment, the LDL is calculated using an on-line estimate of the perceived signal loudness based on signal level, with critical bands, frequency content, signal duration or other relevant psychoacoustic parameters.

Multi-Band Compressor

Figure 7:
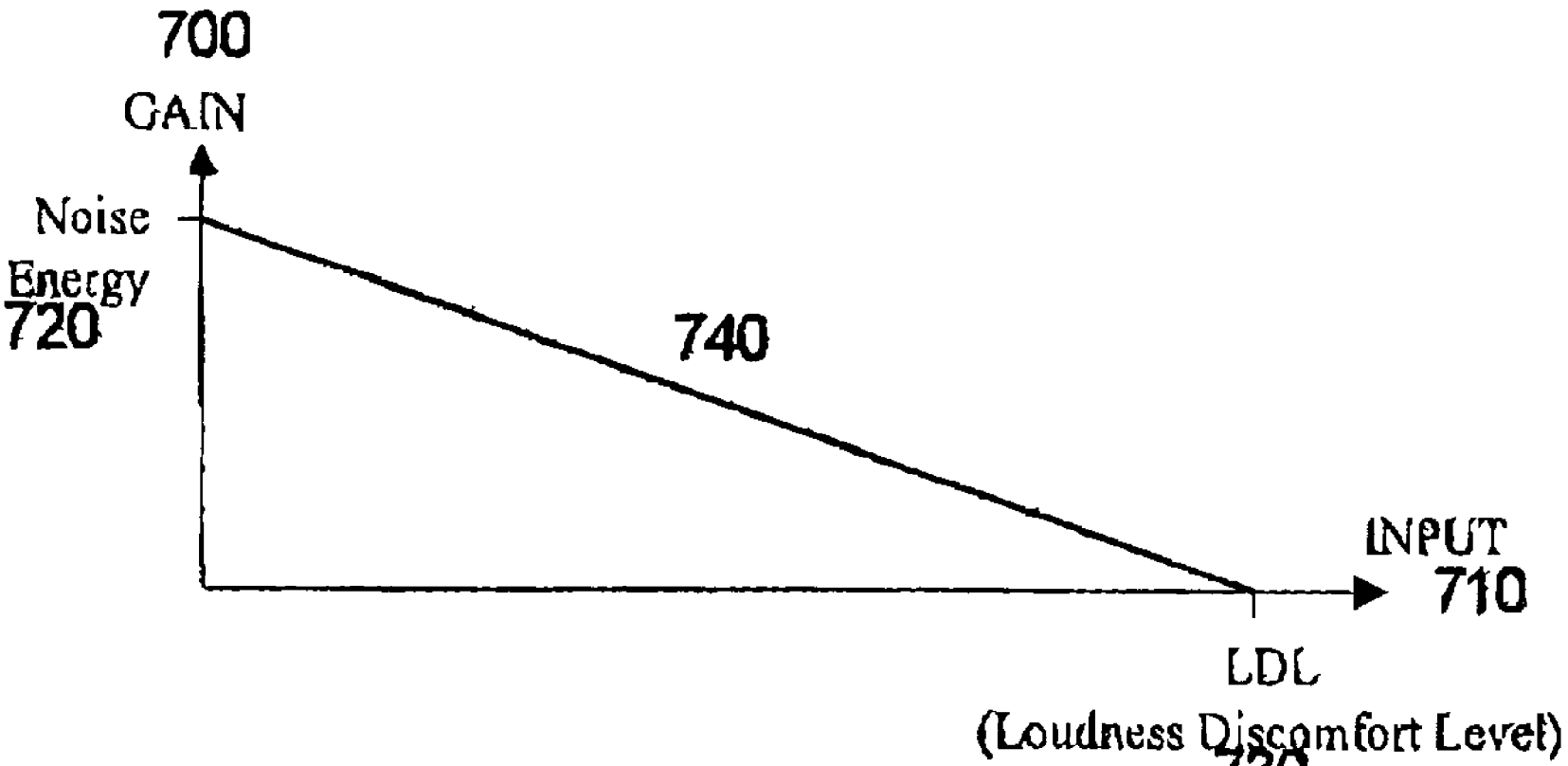
FIG. 7 (prior art)
FIG. 7 shows the input/gain function for straight-line compression.

In a preferred embodiment, a component of the psychoacoustic model is a multi-band dynamic range compressor. Dynamic range compression to a smaller effective dynamic range is accomplished by the use of one of several well-known level mapping algorithms. These can be employed with the support of look-up tables or other well-known means to supply the shape of the compression Input vs. Gain Function, otherwise the gains can be directly calculated based on a mathematical formula. Examples of possible level-mapping algorithms are:

1) Straight-Line Compression—where the Input/Gain Function is a straight line as illustrated in FIG. 7. Here the level-mapping algorithm consists of a mathematical formula for the region of compression as expressed in decibels:

$$\text{Gain} = E_{Noise} * \left(1 - \frac{E(?)}{LDL}\right)$$

(?) indicates text missing or illegible when filed

2) Curvilinear compression—the Input/Gain Function is not straight, but curved to better fit growth-of-loudness perception in the human auditory system. This method yields improved perceptual fidelity but must either rely on a more complex formula or draw information from a look-up table.
3) The psychoacoustic model is incorporated or integrated with the compressor to make the desired signal audible. The time variation of the gains is controlled in such a way that perceptual distortion is minimized and the signal-of-interest is made as audible as possible.

For all level-mapping algorithms, a psychoacoustic model calculates a level to minimize the distortion in a given (sub-band or) channel, by determining what sounds are audible within noise. This information leads to an objective estimation of the quality of the desired signal, enabling the calculation of near-optimal compression parameters. Other level mapping schemes are also possible.

It is often the case that the incoming signal-of-interest is not entirely noise-free. Instead of using compression on the entire dynamic range in his case, it is advantageous to expand (increase dynamic range) for the low-levels of the signal where the noise exists. This is perceived as making the noise quieter in the signal-of-interest and tends to render it inaudible. Where the noise floor of the signal-of-interest is known, the dynamic range re-mapping, previously described with reference to FIG. 2, further reduces the audibility of this noise floor because it is masked by the environmental noise.

In order to deliver high perceptual fidelity in all environments, spectral tilt constraints can be implemented. These constraints prevent the invention from over-processing the sound to the point where the output audio is equalized in such a way that it is objectionable or quality is reduced in spectrally shaped noise environments. In a preferred embodiment, the constraints are implemented by enforcing a maximum gain difference between the various channels in the compressor. When processing used in the invention attempts to exceed the maximum gain difference thresholds, a compromise is made in the channels tending to require more extreme adjustment or adaptation, and more or less gain is applied to satisfy the constraints. Other constraints that use more complex means, such as objective measures of speech quality are also possible.

Each individual is unique, and therefore each individual can determine and set his or her own LDL, desired listening level, and growth of loudness. By a process of personalization, key characteristics of the psychoacoustical operation are adjusted for the individual user (in a manner not unlike adjustments to a heating aid). In a preferred embodiment, these parameters are stored using non-volatile memory as part of the psychoacoustic model.

User SIE Level Adjustment

Users of SIE may want to adjust the sensitivity of the signal-processing algorithm. Users adjusting this control, which can be thought of as an advanced volume control, are typically adjusting the level because tow-level sounds are inaudible (not because high-level sounds are in audible) In a preferred embodiment the parameter "X" described above (in Psychoacoustic Processing) may be made user adjustable to control the sensitivity of the SIE algorithm. Other, more advanced embodiments, where the level adjustment provides a parametric input to the psychoacoustic processing block arc possible and are dependent on the specific type of psychoacoustic processing that is employed.

Combination with Active Noise Cancellation

Figure 8:
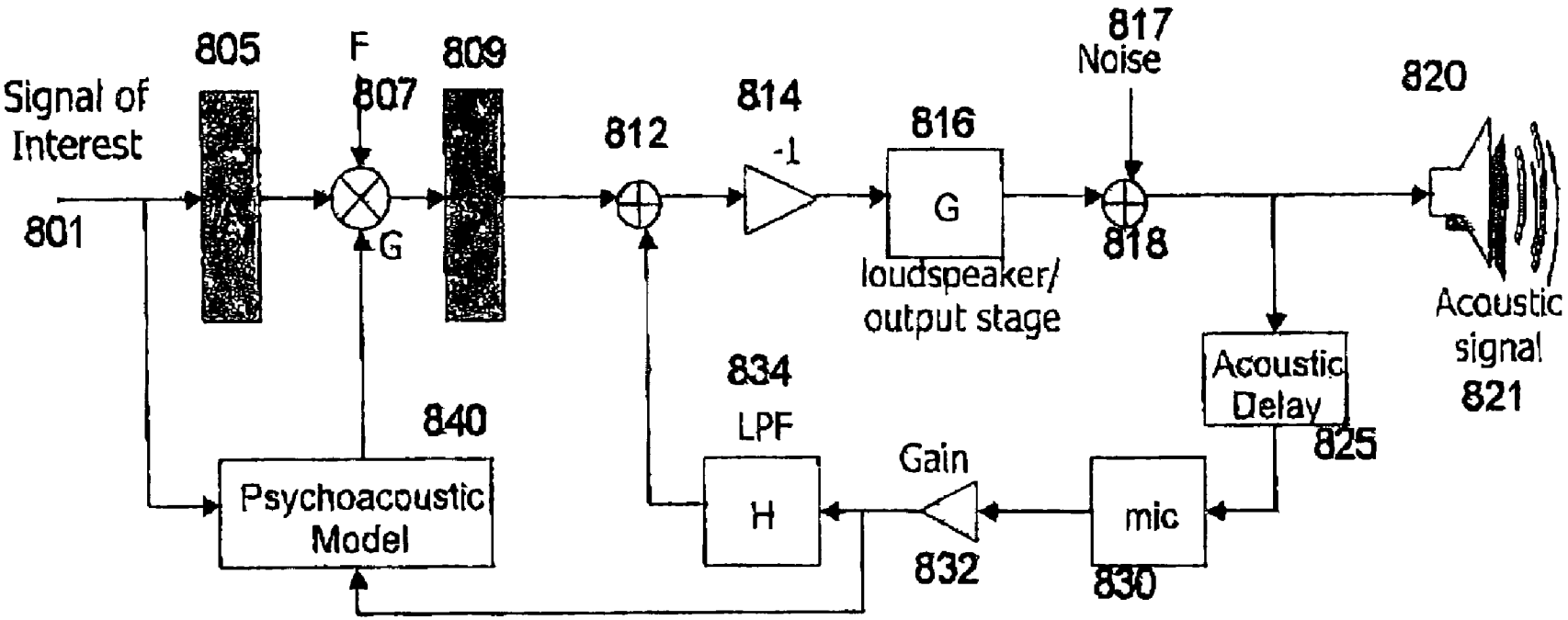
FIG. 8 shows one embodiment of the invention with SIE and ANC combined.

Many headsets today incorporate Active Noise Cancellation (ANC). ANC technology is used to improve signal intelligibility in noisy environments by generating anti-noise that actively cancels the environmental noise. However, ANC is typically only effective for low frequencies because of well-known constraints of feedback systems. By combining the SIE invention with ANC the audio quality and perceptibility is enhanced to a level that cannot be achieved by either method alone FIG. 8 illustrates such a combination. The signal-of-interest 801 enters an analysis filterbank 805, the sub-bands from which pass multipliers 807 and thence to a synthesis filterbank 809 where they are transformed and passed in turn to a summer 812, the output of which passes through an inverter 814, an output stage (amplifier) 826 a second summer 818 where it is combined with the noise signal 17, and thence to the receiver 820. The signal-of-interest is also input by the psychoacoustic model block 840 which controls the sub-bands thorough the multipliers 807. A further input to the psychoacoustic model block 840 is derived from a feedback loop comprising an acoustic delay 825 which feeds the signal used to drive the receiver 820 to a microphone 830, whose output is first amplified 832 then passed to both the fist summer 812 through a low pass filter 834, and to the psychoacoustic model block 840. In some embodiments an associated ANC system has a microphone already in place to sample the noise, and this microphone can be simultaneously used for Signal Intelligibility Enhancement to sample the environmental noise in the ear canal. The combination of these two technologies makes it possible to make each one of them subtler, and therefore less disorienting, while delivering improved quality and perceptibility In a further embodiment a combination of STE and ANC processing is implemented using an oversampled WOLA filterbank as a pre-equalizer to an ANC system. The ANC system may be implemented using analog or digital signal processing of a combination of these two. This ANC processing is well-known in the art and is therefore not described. The WOLA measures the pre-equalized residual noise in the ear canal (closed loop ANC) or the outside environmental noise (open loop ANC) and uses the resultant spectral information as input to a psychoacoustic model that provides dynamic range parameters for the pre-equalizer.

Binaural Operation

Figure 9:
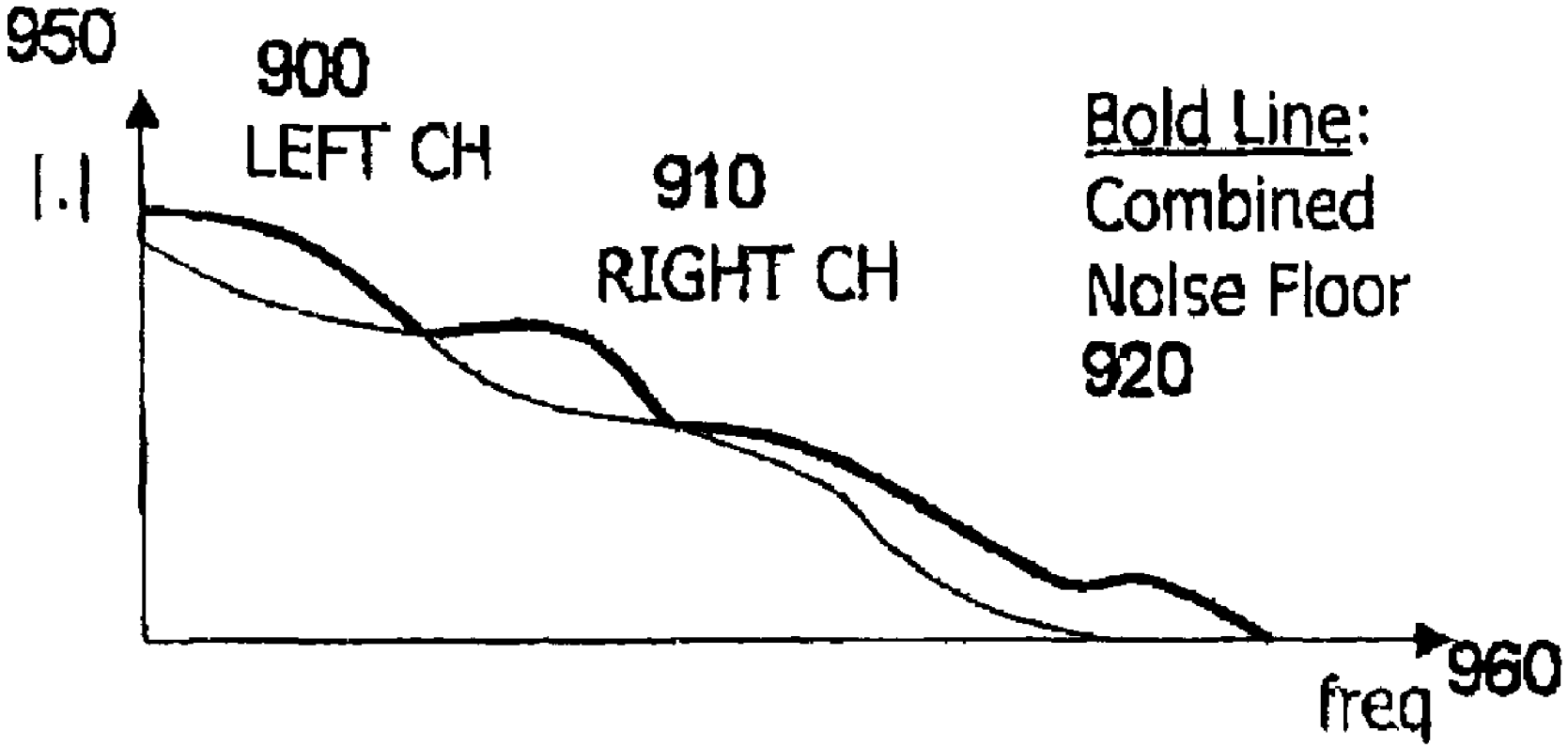
FIG. 9 is a-diagram illustrating combining left and right noise floors.

When used in a stereo audio system (e.g., binaural headset or in headphones). joint-channel processing extensions for SIE wan be incorporated. Two cases are considered:

1) There is a microphone for each ear outside (open loop) or inside (closed loop) the ear cup. In this case, as graphically shown in FIG. 9, which has axes of Noise level 950 versus frequency 960, the noise floor for the right channel 910 and left channel 900 is combined by some means (e.g., taking the maximum level or average of the left and right sides in each channel, or in each sub-band of each channel) to provide a combined noise floor 920

2) There is only one microphone on one of the ear cups or elsewhere on the apparatus. In this case, only one noise measurement is available.

Having only one noise measurement for the SIE algorithm is important since a stereo compressor scheme (possibly with independent noise measurements) may lead to undesired independent channel adjustment and a consequent reduction in perceived audio quality. When there is only one measure of the environmental noise for the user, both right and left sides of the SIE processing scheme use the same information. In the case of a stereo signal-of-interest, two SIE processing apparatus use the same environmental noise level to control the subsequent processing of each audio stream.

Figure 10:
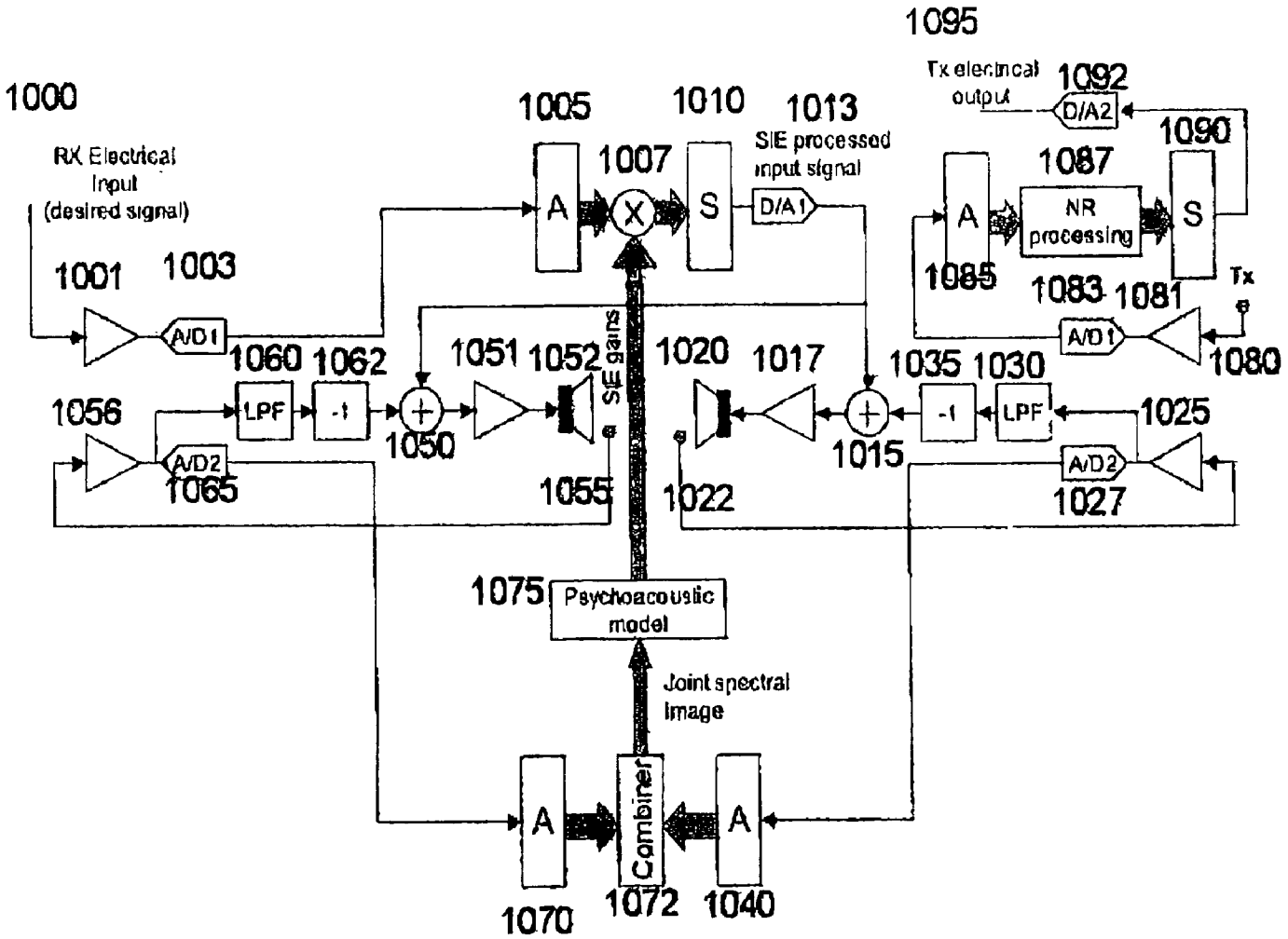
FIG. 10 shows a binaural combination system with transmit algorithm capability.

In one embodiment shown in FIG. 10 a binaural headset 1020, 1052 is used with a monaural signal 1000. A typical application is a cell phone headset with monaural speech. A single SIE processing apparatus composed of a combiner 1072, a psychoacoustic model block 1075 and feeding a multiplier 1007 is implemented. Following amplification by amplifier 1001, and digital to analog conversion 1003, the input (desired) signal 1999 is split into sub-bands by a first analysis filterbank 1005, each sub-band is multiplier 1007 with the appropriate output from the psychoacoustic model block 1075 and then transformed into a single band by the synthesis filterbank 1013. This 'single band' electrical signal is sent to both output transducers 1020, 1052 via their respective low pass filters 1030, 1060, inverters 1035. 1062, summers 1015, 1050 and amplifiers 1017, 1051, these signals being further individually modified based on the input from noise sensing microphones 1022, 1055 located close to their respective receivers 1020, 1052. The psychoacoustic model block 1075 also uses signals from the noise sensing microphones 1022, 1055 whose outputs are passed through their respective analog-to-digital converters 1027, 1065 to second and third analysis filterbanks 1040, 1070 whose output sub-bands are combined at a combiner 1072 to form a joint spectral image to be processed by the psychoacoustic model block 1075 to produce the appropriate gain control, signals for each of the sub-bands in the multipliers 1007. This scheme has the advantage of using only one D/A converter 1013 to deliver the processed signal out to the two output transducers 1020, 1052.

The feedback path comprising 1025. 1030, 1035 and 1015 (or 1056, 1060, 1062 and 1050) implements the combination an ANC system combined with SIE as described previously.

Shared Noise Microphone

Figure 11:
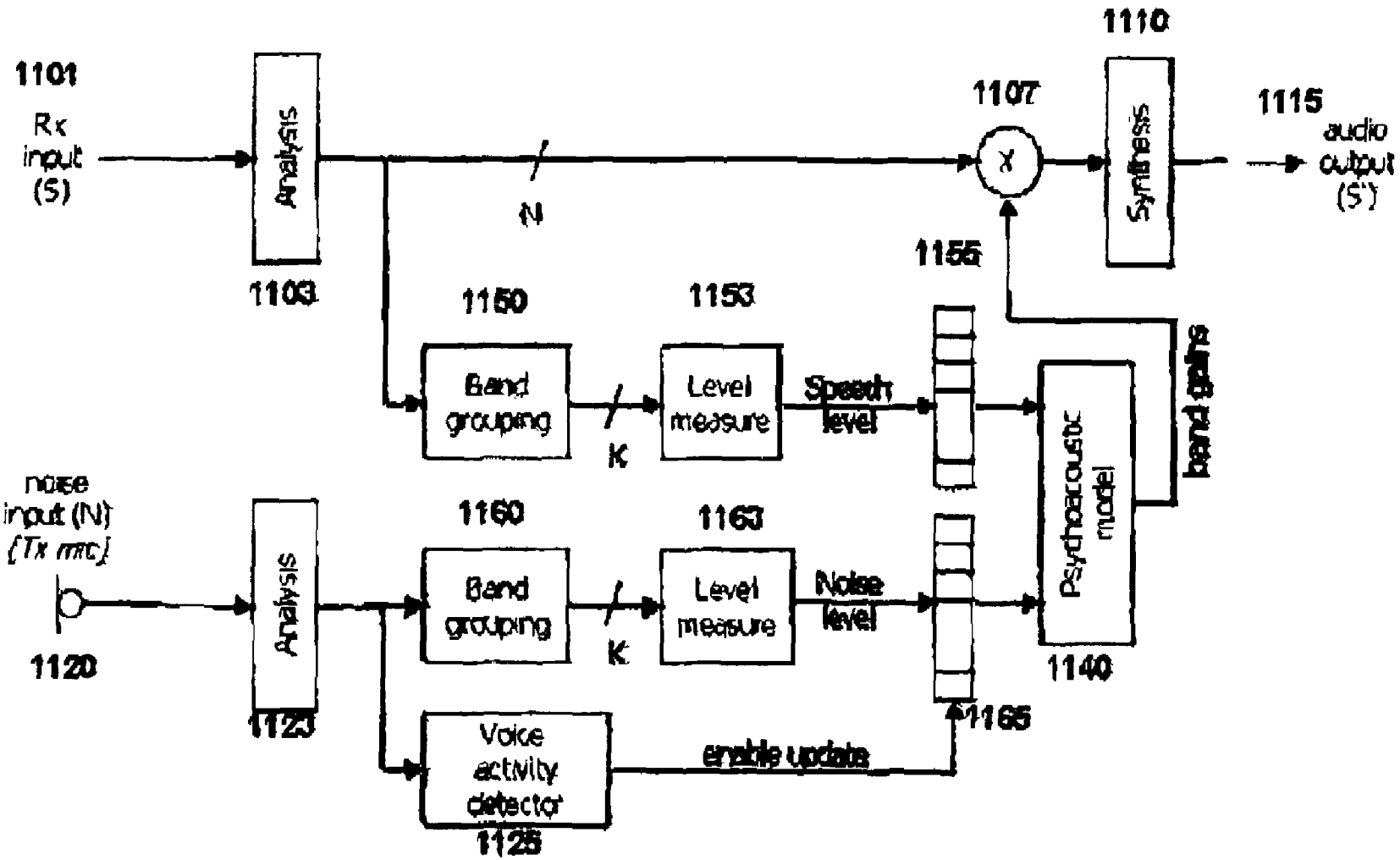
FIG. 11 is a block diagram showing an open-loop STE with shared transmitting (Tx) microphone.

A further embodiment of the SIE invention is used in an open-loop configuration (typically used in telecommunications headset), shown in FIG. 11 in which the microphone 1120 used for the reception of transmitted (Tx) speech is also used to sample the environmental noise—the so-called shared microphone technique. The signal-of-interest 1101 is split into N sub-bands by a first analysis filterbank 1103, and the sub-bands grouped into K channels by the band grouping block 1150. The level of each of these 'signal of interest' channels is measured by a Level Measuring block 1153 and the level stored in the appropriate register 1155. Each sub-band is also modified by a multiplier 1107 and the sub-bands reassembled into a single band by a synthesis filterbank 1110 and passed to the audio output 1115. The sample of environmental noise from the microphone 1120 is similarly split into N sub-bands by a second analysis filterbank 1123, and the resultant sub-bands grouped into K channels by a further band grouping block 1160. The level of each of these 'noise' channels is measured by a Level Measuring block 1163 and the level stored in the appropriate register 1165. The psychoacoustic model block 1140 uses the values of the levels stored in the signal-of-interest level register, and in the noise level register to determine the gains to be applied by the multiplier 1107 to each band of the incoming signal of interest 1101. The voice activity detector 1125 monitors the output of the noise analysis filterbank 1123 and detects gaps in the transmit signal (voice). It is only when such gaps occur that the level measured can be considered correct. Therefore a signal is passed from the voice activity detector 1125 to the level register 1165 indicating when there is no voice activity. This strategy reduces cost and decreases hardware complexity.

Figure 12:
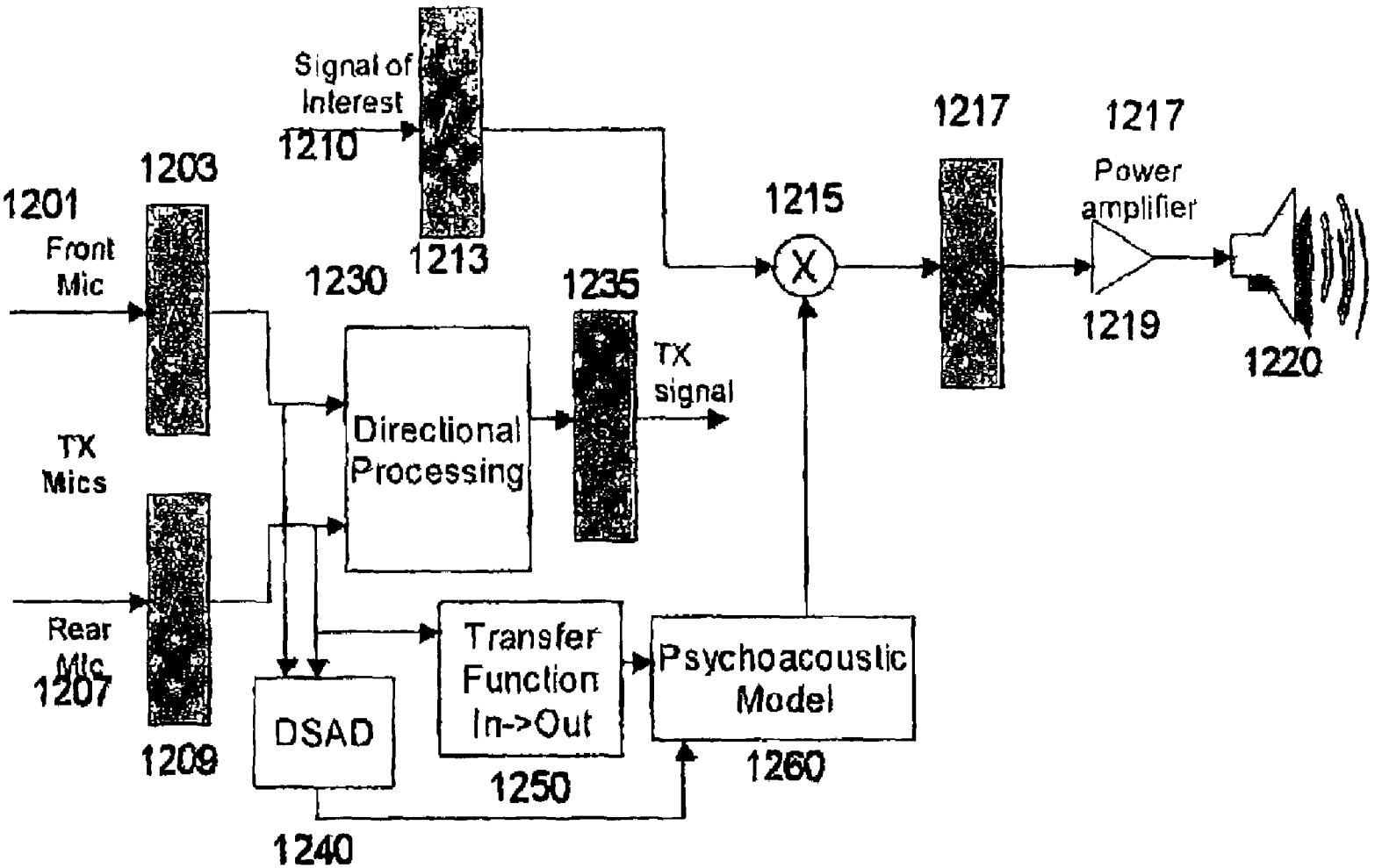
FIG. 12 is a block diagram showing an open-loop SIE with shared Tx microphones and directional processing.

In other embodiments, algorithms to restore the transmitted signal can also be incorporated with open-loop microphone-sharing SIE system of FIG. 11. For example, in FIG. 12, a well-known in the art or co-pending directional processing algorithm is used to noise-reduce the transmitted signal, but the same microphones that are used for the signal can be used to estimate the environmental noise employing the techniques described for FIG. 11. In FIG. 12 the path for the signal-of-interest 1210 is similar to that of the previous embodiment in that the signal-of-interest 1210 is split into sub-bands by a first analysis filterbank 1213, each sub-band is modified by a multiplier 1215 and the sub-bands transformed into a single band by a synthesis filterbank 1217 to be amplified 1219 for the receiver 1220. However, in contrast, the noise signal is derived from two microphones 1201, 1207, the so-called front and back microphones, whose outputs are split into sub-bands by respective second and third analysis filterbanks 1203, 1209. Both sets of sub-bands are used by a directional processing block 1230, and are not discussed or otherwise relevant here. The same sets of sub-band signals are passed to a Desired Signal Activity Detector(DSAD) block 1240, and the output of that block 1249 passed to the psychoacoustic model block 1260 controlling the multipliers 1215. At the same time the output of the-third analysis filterbanks 1209, corresponding to a microphone situated furthest from the transmitted signal, passes through a transfer function block 1250 to the psychoacoustic model block, 1260. It is desirable to determine the transfer function 1250 from the Tx microphone to the output transducer to provide an accurate estimate of the noise level in the ear canal, thereby approximating the closed-loop condition.

In an alternative embodiment (not shown in FIG. 12), the directional processing block provides an output noise estimate that is generated by aiming a beam away from the transmitted signal source to obtain a noise estimate that contains less transmitted speech. In an additional embodiment, the directional output can be subtracted from one of the microphones to obtain an improved estimate of the noise.

Note that front end processing techniques such as DSAD, adaptive noise estimation or spectral differencing noise estimation can be used in any open-loop configuration. Other front-end processing (like directional processing) allows some separation of the speech from noise thereby improving performance.

Other features and aspects of the present invention, and the advantages associated therewith are described below:

1) Signal intelligibility is improved. At the same time, signal fidelity and quality are maintained, and perceived quality can improve in noisy environments.

2) The use of psychoacoustic models and high-fidelity, constrained dynamic range adaptation means that the utility of the dynamic range is maximized (where dynamic range is the level difference between the minimum signal level that is audible above the noise and the maximum allowable signal level). This results in excellent signal quality and fidelity.

3) The design can be implemented using ultra low-power, sub-miniature technology that is suitable for incorporation directly into a headset or other low-power, portable audio applications (see U.S. Pat. No. 6,240,192 Schneider & Brennan, Apparatus for and method of filtering in a digital hearing aid, including an application specific integrated circuit and a programmable digital signal processor). Implementations using oversampled filterbanks (see U.S. Pat. No. 6,236,731 Schneider & Brennan, Filterbank structure and method for filtering and separating an information signal into different bands, particularly for audio signal in hearing aids) provide a high-fidelity, ultra low-power solution that are ideal for portable, low-power audio applications.

4) When combined with a closed-loop, active noise cancellation (ANC) system, advantage can be taken of the fact that they both require means to measure the undesired noise at a point close to the output transducer. As a result the same microphone (located near the output transducer) can be used for both the measurement of the signal to generate the "anti-noise" and to provide the residual level measurement from which to compute the input level estimate required for the signal intelligibility enhancement (SIE) processing. This combined approach works better than either method alone because ANC is limited to providing benefit at low frequencies (because of design considerations) and the signal intelligibility enhancement provides benefit at higher frequencies. Using the same microphone reduces costs and simplifies the system. In many listening situations, low-frequency noise dominates. Here, the use of ANC at low frequencies to reduce the noise increases the available dynamic range, which results in improved fidelity relative to either method (ANC or SIE) being used alone.

5) In cases where the signal-of-interest contains noise, the signal-of-interest can be processed, using a psychoacoustic model and/or low-level expansion, such that the level of the noise is effectively below the acoustic signal level (or the residual signal level if ANC is being applied). When this is properly implemented, the listener perceives less noise.

6) Single-microphone noise reduction techniques can be incorporated into the signal-of-interest channel as described in the PCT/Canadian Patent Application PCT/CA98/00331 Brennan, Robert, Method and Apparatus for Noise Reduction, Particularly in Hearing Aids. This provides a signal for the listener that is more audible (relative to the environmental noise) and less tiring to listen to for extended periods of time because the processed signal-of-interest contains less noise.

7) When used with a Desired Signal Activity Detector (DSAD), an implementation is able to differentiate between a signal-of-interest and the environmental noise (interference). This ensures that the estimate of the noise signal does not become contaminated with the signal-of-interest, allowing voice communications to be clearer with higher intelligibility.

8) In an alternative embodiment of the invention, an adaptive filter is used to correlate the contaminated signal (signal+noise) with the uncontaminated electrical signal so that an estimate of the noise can be derived. This provides a more reliable estimate of the noise signal that is contaminating the signal-of-interest. Employing this technique provides improved signal fidelity.

9) In an alternative embodiment of the invention, a spectral differencing technique is used to estimate the spectral content of the environmental noise. This provides a more reliable estimate of the noise signal that is contaminating the signal-of-interesting. This processing also improves signal fidelity.

10) With a multi-band implementation of the compressor component (ranges of frequency are treated independently as opposed to compressing the entire spectrum uniformly) more accurate mapping in the residual dynamic range can be made and the overall perceived audio quality is improved as described in Schneider & Brennan, A Compression Strategy for a Digital Hearing Aid, Proc ICASSP 1997, Munich, Germany Treating frequency bands independently of one another allows for greater freedom to produce high-fidelity compression. Furthermore, constraining the relative compression levels of the frequency ranges so a predetermined maximum amount of frequency shaping may occur, maintains the signal quality across a wide range of noise environments. This ensures that frequency localized noise sources are better handled.

11) Using a multi-band and/or adaptive level measurement of the noise allows an implementation to smoothly handle any changes of noise environment. It also protects against undesirable distortion, which would otherwise be caused by drastic changes in the environmental noise. See Schneider. Todd A. An Adaptive Dynamic Range Controller. MASc Thesis, University of Waterloo, Waterloo, Ontario, Canada, 1991, and Schneider & Brennan, A Compression Strategy for a Digital Hearing Aid, Proc. ICASSP 1997, Munich, Germany.

12) A safety system is implicitly incorporated into the invention. The signal processing does not amplify desired sounds above the user's Loudness Discomfort Level (LDL). This is a safety feature designed to help protect the user's hearing in very high noise environments. It, along with the other adjustments provided by the invention, provide the opportunity to personalize an implementation to a specific user.

While the present invention has been described with reference to specific, embodiments, the description is illustrative of the invention and is not to be construed as limiting the invention. Various modifications may occur to those skilled in the art without departing from the true spirit and scope of the invention as defined by the appended claims.

What is claimed is:

1. A system for improving a signal intelligibility over an interference signal, the system comprising:

a first input for receiving an information signal including a signal-of-interest possibly contaminated with environmental noise;

a second input for receiving an interference signal including the environmental noise, the second input being capable of receiving the interference signal on a continuous basis regardless of whether the signal-of-interest is present or absent;

an analysis filterbank for receiving the information signal through the first input and transforming the information signal in the time domain into a plurality of sub-band information signals in the transform domain;

a signal processor for receiving and processing the sub-band information signals output from the analysis filterbank and the interference signal received through the second input on a continuous basis, the signal processor including a psychoacoustic processor for computing a dynamic range using a psychoacoustic model to render the sub-band information signal audible over the interference signal, and a synthesis filterbank for combining the audible sub-band information signals output from the signal processor to generate an output signal having the signal-of-interest with improved signal intelligibility.

2. The system as claimed in claim 1 further comprising an analysis filterbank for transforming the interference signal in the time domain into a plurality of sub-band interference signals in the transform domain.

3. The system as claimed in claim 2, wherein the signal processor further comprises a compressor for implementing dynamic range compression on the sub-band information signals based on the dynamic range parameters supplied by the psychoacoustic processor.

4. The system as claimed in claim 1, wherein the signal processor further comprises a circuit for expanding the dynamic range for a predetermined level of the signal-of-interest to render the environmental noise inaudible.

5. The system as claimed in claim 1, wherein the psychoacoustic processor processes input signals to perform a low-level expansion such that a user who receives the output signal perceives less noise.

6. The system as claimed in claim 1, wherein the psychoacoustic processor computes the dynamic range based on a Loudness Discomfort Level (LDL) so as to render the output signal at a loudness comfort level.

7. The system as claimed in claim 6 further comprising a persistent data storage apparatus for storing the LDL for each user who receives the output signal.

8. The system as claimed in claim 3, wherein the psychoacoustic processor computes the dynamic range so as to protect a user who receives the output signal.

9. The system as claimed in claim 1, wherein a sensitivity of the signal processing in the signal processor is adjustable.

10. The system as claimed in claim 9 further comprising a memory for storing a parameter for each user who receives the output signal for controlling the sensitivity of the signal processing.

11. The system as claimed in claim 1, wherein the signal processor further comprises a circuit to adjust a volume of the output signal.

12. The system as claimed in claim 1, wherein the signal processor further comprises a noise estimation circuit for estimating a spectrum of the environmental signal, the spectrum being supplied to the psychoacoustic model.

13. The system as claimed in claim 12, wherein the noise estimation circuit performs an adaptive noise estimation.

14. The system as claimed in claim 12, wherein the noise estimation circuit performs a noise estimation by spectral differencing technique.

15. The system as claimed in claim 1, wherein the signal processor further comprises a noise estimation circuit for estimating a spectrum of the environmental noise, and a desired digital signal activity detector (DSAD) for controlling the noise estimation circuit such that the spectrum is sampled when the signal-of-interest is absent.

16. The system as claimed in claim 15 further comprising a front-end processor for improving the intelligibility of the output signal.

17. The system as claimed in claim 16, wherein the front-end processor includes a circuit for performing a directional processing algorithm to provide a noise estimation.

18. The system as claimed in claim 16, wherein the front-end processor includes a circuit for reducing the environmental noise.

19. The system as claimed in claim 1 further comprising an Active Nose Cancellation (ANC) circuit for actively canceling the environmental noise by feed-backing a result of the signal processing to the signal processor.

20. The system as claimed in claim 1, wherein the interference signal comprises the environmental noise contaminated with the signal-of-interest.

21. The system as claimed in claim 20 further comprising an adaptive correlator for outputting an estimate of the environmental noise based on the information signal and the interference signal.

22. The system as claimed in claim 20, wherein the signal processor further comprises a desired digital signal active detector (DSAD) for controlling the noise estimation.

23. The system as claimed in claim 2, wherein the signal processor comprises a noise estimation circuit for performing an estimate of the environmental noise by subtracting the sub-band information signals from the sub-band interference signals, the estimate being supplied to the psychoacoustic model.

24. The system as claimed in claim 1, wherein the analysis filterbank and the synthesis filterbank are implemented by oversampled filterbanks.

25. The system as claimed in claim 2, wherein the analysis filterbank for the information signal and the analysis filterbank for the interference signal are implemented by oversampled filterbank.

26. A method of improving signal intelligibility over an interference signal, the method comprising:

at a first input, receiving an information signal including a signal-of-interest possibly contaminated with environmental noise;

at a second input, receiving an interference signal including the environmental noise, the second input being capable of receiving the interference signal on a continuous basis regardless of whether the signal-of-interest is present or absent;

at an analysis filterbank, transforming the information signal from the time domain into a plurality of sub-band information signals in the transform domain;

at a signal processor, processing the sub-band information signals and the interference signal on a continuous basis, including the step of computing a dynamic range using a psychoacoustic model to render the sub-band information signal audible over the interference signal, and at a synthesis filterbank, combining the audible sub-band information signals to generate an output signal having the signal-of-interest with improved signal intelligibility.

27. A method as claimed in claim 26 further comprising: estimating a spectrum of the environmental signal; and supplying the spectrum to the psychoacoustic model.

28. A method as claimed in claim 26 further comprising: estimating a spectrum of the environmental signal; and controlling the estimating step such that the spectrum is sampled when the signal-of-interest is absent.

29. A method as claimed in claim 26 further comprising: feed-backing a result of the signal processing to the signal processor to actively cancelling the environmental signal.

* * * * *